United States Patent [19]

Kato et al.

[11] Patent Number: 4,662,124

[45] Date of Patent: May 5, 1987

[54] METHOD OF GRINDING A SAPPHIRE WAFER

[75] Inventors: Ichiro Kato; Sigekazu Suzuki, both of Yokohama, Japan

[73] Assignees: Tokyo Shibaura Denki Kabushiki Kaisha, Kawasaki; Toshiba Ceramics Co., Ltd., Tokyo, both of Japan

[21] Appl. No.: 610,925

[22] Filed: May 15, 1984

Related U.S. Application Data

[63] Continuation of Ser. No. 318,363, Nov. 5, 1981, abandoned.

[30] Foreign Application Priority Data

Nov. 17, 1980 [JP] Japan ..... 55-161677

[51] Int. Cl.[4] ..... B24B 1/00

[52] U.S. Cl. ..... 51/283 R; 51/327; 29/576 T

[58] Field of Search ..... 51/283 R, 326, 327, 51/281 R; 29/576 T, 576 R

[56] References Cited

U.S. PATENT DOCUMENTS 3,650,074 3/1972 Weinz ..... 51/283 R
4,270,316 6/1981 Kramer et al. ..... 51/283 R

FOREIGN PATENT DOCUMENTS 0280683 of 1970 U.S.S.R. ..... 51/283

OTHER PUBLICATIONS

Keyser, Carl A., Materials of Engineering, Prentice-Hall, Inc., p. 467, Copyright 1956.

Damage Free Polishing of Polycrystalline Silicon, Nilsson et al., Journal of Electrochem Soc., vol. 128, No. 1, Jan. 1981.

*Primary Examiner*—Frederick R. Schmidt
*Assistant Examiner*—Robert A. Rose
*Attorney, Agent, or Firm*—Oblon, Fisher, Spivak, McClelland, & Maier

[57] ABSTRACT

A sapphire wafer-grinding method which can minimize the warp of a plane ground sapphire wafer. A sapphire wafer used with a semiconductor device is so fabricated that its surface is constituted by an R plane $\{1\bar{1}02\}$. A plurality of C planes or atomic net planes (0001) extend in parallel crosswise of the sapphire wafer at an inclination angle of about 57.6° to the surface or R plane $\{1\bar{1}02\}$ of the sapphire wafer. The particles of a rotating grindstone are moved in the normal inclination direction of the C planes (0001) of the sapphire wafer to grind the surface or R plane $\{1\bar{1}02\}$ of the sapphire wafer. The normal inclination direction of the C planes (0001) of the sapphire wafer includes the directions which are deflected on the R plane from the projection of the C axis [0001] of the sapphire wafer to an extent of ±35°.

2 Claims, 14 Drawing Figures

FIG. 12
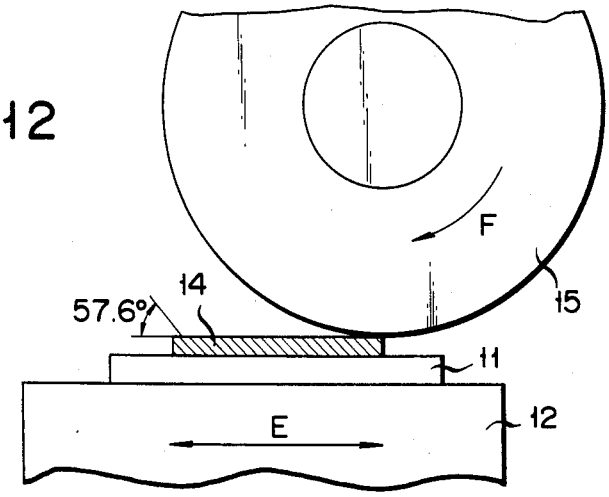
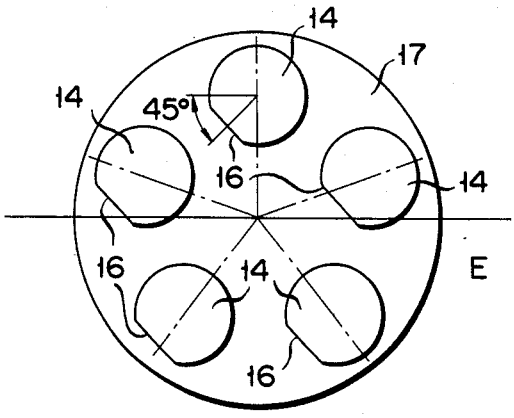
FIG. 13
FIG. 14
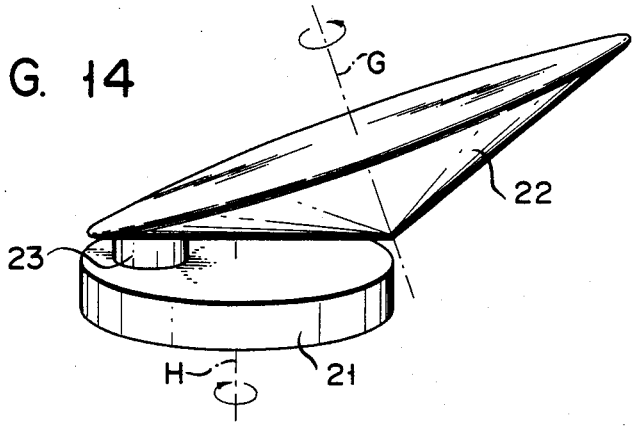

METHOD OF GRINDING A SAPPHIRE WAFER

This application is a continuation of application Ser. No. 318,363, filed Nov. 5, 1981 now abandoned.

BACKGROUND OF THE INVENTION

I. Field of the Invention

This invention relates to a method of grinding a monocrystalline sapphire wafer used with a semiconductor device.

II. Description of the Prior Art

A monocrystalline sapphire (hereinafter referred to as sapphire) has a hexagonal crystalline structure. A sapphire wafer used with a semiconductor device is fabricated in such a manner that the R plane $\{1\bar{1}02\}$ of said wafer constitutes its surface. The surface or R plane $\{1\bar{1}02\}$ of the sapphire wafer is conventionally ground by attaching the wafer to a wafer holder, linearly reciprocating the wafer holder, and contacting a rotating grindstone on the surface of the wafer. In this case, as shown in FIG. 1, the direction in which the wafer is held is defined by setting an orientation flat a (a plane defining an angle of 45° with a projection of the C axis [0001] of the sapphire wafer c and intersecting the R plane at right angles) in parallel with the grinding direction b, or as shown in FIG. 2, setting said orientation flat a in a random direction relative to the grinding direction b. However, many of the sapphire wafers ground by the above-mentioned conventional process are considerably warped as a whole. The prominent warp (i.e., the overall deformation in surface height) of a sapphire wafer presents various difficulties in setting up a semiconductor device on said sapphire wafer, including, for example, the drawback that masking tends to be accompanied with displacement.

SUMMARY OF THE INVENTION

It is accordingly the object of this invention to provide a method of grinding a sapphire wafer which minimizes the warp of a ground sapphire wafer.

To attain the above-mentioned and other objects, this invention provides a method of grinding a sapphire wafer, which comprises the steps of:

holding a sapphire wafer in position to grind the main surface of the sapphire wafer and grinding the main surface of the sapphire wafer with a grind stone such that the working surface of the grind stone moves perpendicularly to the parallel lines defined by the intersections of the C planes (0001) with the R plane $\{1\bar{1}02\}$ within an accuracy of ±35° lateraly deflection in the R plane $\{1\bar{1}02\}$.

BRIEF DESCRIPTION OF THE DRAWING

FIGS. 11 and 12 indicate the manner in which a sapphire wafer is ground by a method according to one embodiment of this invention;

FIG. 13 shows the manner in which a sapphire wafer is ground by a method according to another embodiment of the invention; and FIG. 14 sets forth the manner in which a sapphire wafer is ground by a method according to a third embodiment of the invention.

DETAILED DESCRIPTION OF THE PREFERRED EMBODIMENTS

Figure 3:
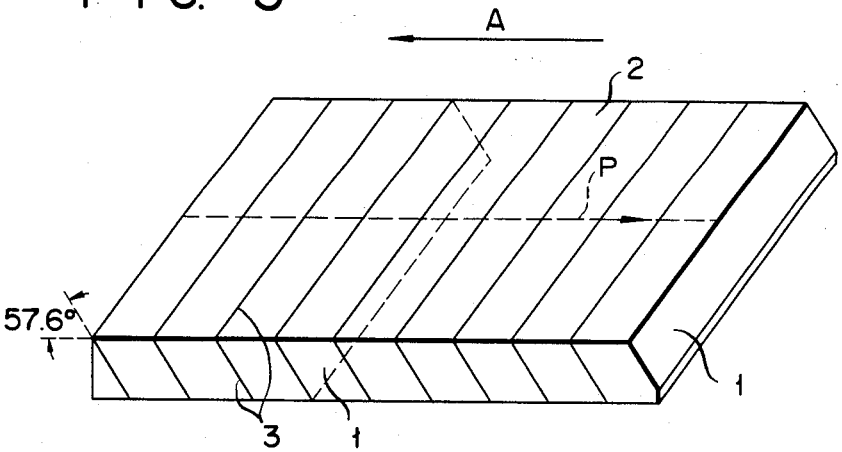
FIG. 3 illustrates the structure of a sapphire wafer.

A sapphire wafer used with a semiconductor device is so fabricated that the R plane $\{1\bar{1}02\}$ of said wafer constitutes its surface. FIG. 3 illustrates the typical structure of a sapphire wafer. Reference numeral 2 denotes the surface of the sapphire wafer, or the R plane $\{1\bar{1}02\}$ of said wafer. Reference numeral 1 shows a plurality of the C planes or atomic net planes (0001) extending in parallel crosswise of the wafer at an angle of inclination of about 57.6° to the above-mentioned R plane $\{1\bar{1}02\}$. Reference numeral 3 shows the edges of one of said plurality of C planes (0001). Reference character P indicates the projection of a C axis [0001]. With an actual sapphire wafer, the respective C planes (0001) are obviously spaced from each other at a far smaller distance than indicated.

If a wafer is regarded as composed of a plurality of parallel layers, then the respective C planes (0001) may be considered as the interface planes between said plurality of parallel layers, as seen from FIG. 3. The direction indicated by an arrow A given in FIG. 3 denotes the direction in which the C planes (0001) are normally inclined to the R plane $\{1\bar{1}02\}$ (hereinafter referred to as "the normal inclination direction of the C planes (0001)"). A direction opposite to that of the arrow A is taken as the opposite inclination direction of the C planes (0001)). Both normal and opposite inclination directions of the C planes (0001) extend along the same straight line as that defined by the projection P of the C axis [0001]. As used herein, the term "the normal inclination direction of the C planes (0001)" includes directions deflected from the direction of the arrow A (the direction of the projection of the C axis) at angles ±35°. For convenience, the directions deflected from the direction of said arrow A at a wider angle than specified above are hereinafter referred to as "opposite inclination direction of the C planes (0001)".

Figure 4:
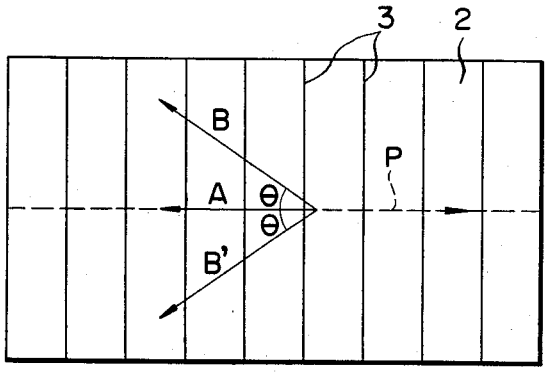
FIG. 4 indicates the inclined direction of the C planes (0001)

FIG. 4 is a top view of FIG. 3. As defined herein, the normal inclination direction of the C planes (0001) includes all directions falling between the rigidly defined normal inclination direction of the C planes (0001) and the directions indicated by arrows B, B′ which are deflected at angles $\theta = \pm 35°$ from the same line as the projection P of the C axis. Directions deflected from said projection P at wider angles than specified above are referred to as "the opposite inclination directions of the C planes (0001)" for the sake of convenience.

Figure 1:
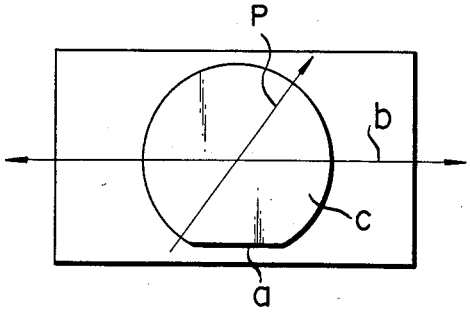
FIG. 1 PRIOR ART
FIGS. 1 and 2 indicate the direction in which sapphire wafers have been ground by two conventional processes.
Figure 2:
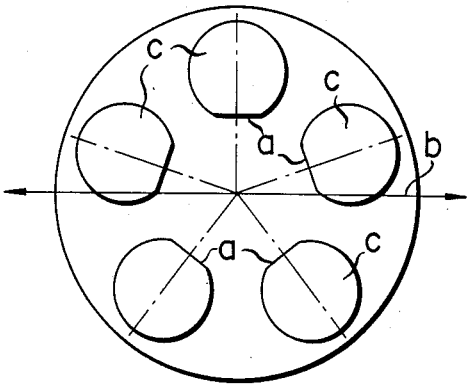
FIG. 2 PRIOR ART

A sapphire wafer has been known to contain the above-mentioned C planes (0001). To date, however, no heed has been given to the relationship between the grinding direction relative to the inclination direction of the C planes (0001) and the magnitude of the warp of a ground wafer. Hitherto, therefore, a sapphire wafer has been habitually ground with the orientation flat a set in parallel with the grinding direction b (FIG. 1) or with the orientation flat a directed entirely at random (FIG. 2).

The present inventors have thought of the fact that a certain relationship exists between the grinding direction relative to the inclination direction of the C planes (0001) of the sapphire wafer and the magnitude of the warp of a ground sapphire wafer, and that where the particles of a rotating grindstone are shifted in the normal inclination direction of the C planes (0001) (hereinafter referred to as "grinding in the normal inclination direction of the C planes (0001)"), then the warp of a ground sapphire wafer is minimized. The following experiments were conducted to confirm this fact.

Figure 5:
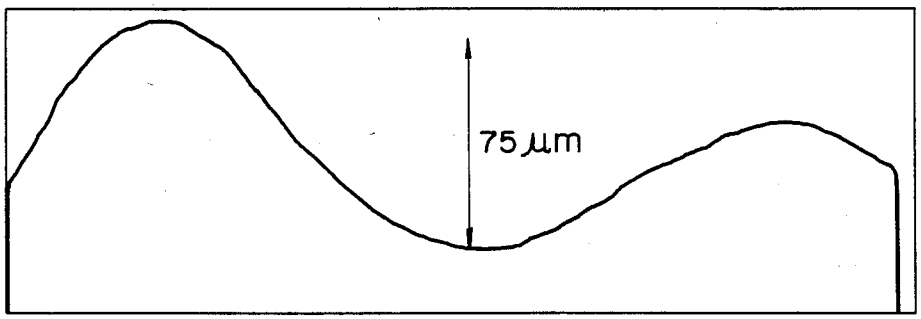
FIGS. 5 to 7 and FIG. 10 show the relationship between the grinding direction of a grindstone and the magnitude of the warp of a ground sapphire wafer.
Figure 6:
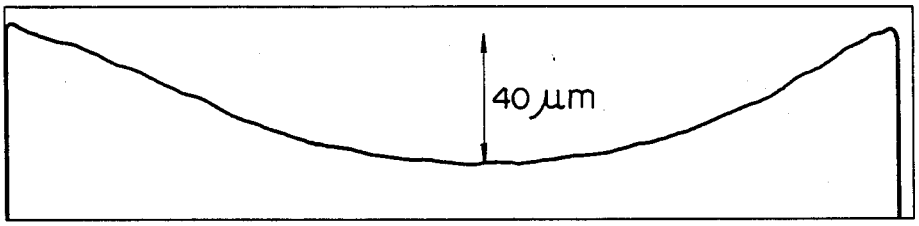
Figure 7:
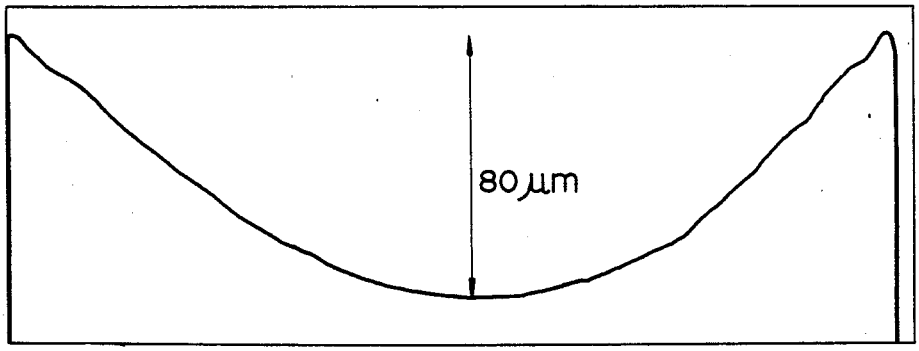

Sample sapphire wafers were respectively ground in the conventional direction (FIG. 1) (a direction deflected at an angle of 45° from the rigidly defined normal inclination direction of the C planes (0001)), in the rigidly defined normal inclination direction of the C planes (0001), and a direction exactly opposite to the rigidly defined normal inclination direction of the C planes (0001). Measurement was made of the magnitude of the warp of the ground sample sapphire wafers on the backside thereof, the results being set forth in FIGS. 5 to 7. Where a sample sapphire wafer was ground in the conventional direction (FIG. 5), then the ground sapphire wafer suffered as large a warp as 75 microns. Moreover, said warp showed an irregular form. This drawback is assumed to arise from the fact that the grinding was carried out in the opposite inclination direction of the C planes (0001), leading to the substantial damage to the wafer and the occurrence of fine cracks with great depth and density, giving rise to substantial residual strains. Where a sample sapphire wafer was ground in a direction exactly opposite to the rigidly defined normal inclination direction of the C planes (0001) (FIG. 7), then the ground sapphire wafer suffered as prominent a warp as 80 microns, though the warp did not assume an irregular form as in the preceding case. Where a sample sapphire wafer was ground in the rigidly defined normal inclination direction of the C planes (0001) (FIG. 6), then the ground sapphire wafer suffered a far smaller warp (40 microns) than in the two preceding cases. Moreover the warp did not show an irregular form.

Figure 8:
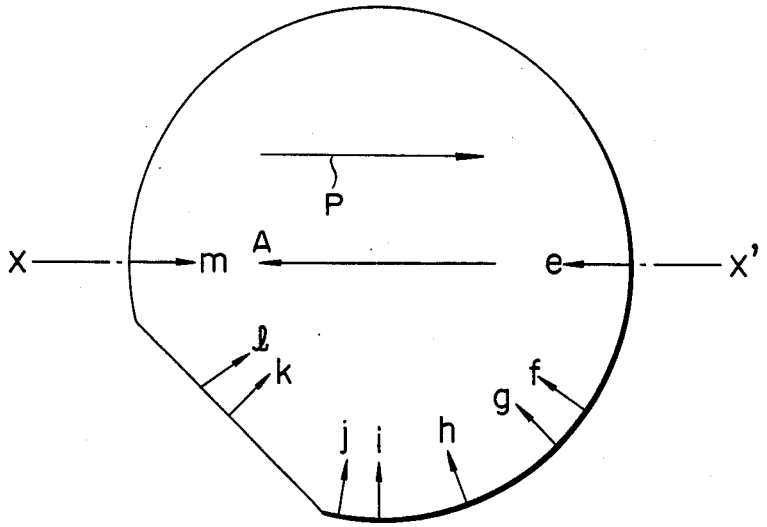
FIGS. 8 and 9 indicate the direction in which a sapphire wafer was ground in experiments.
Figure 9:
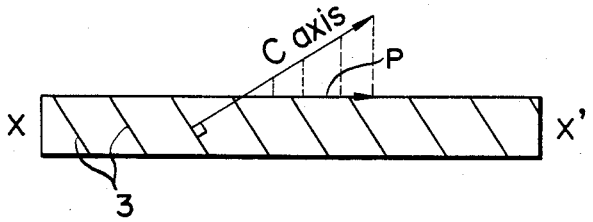
Figure 10:
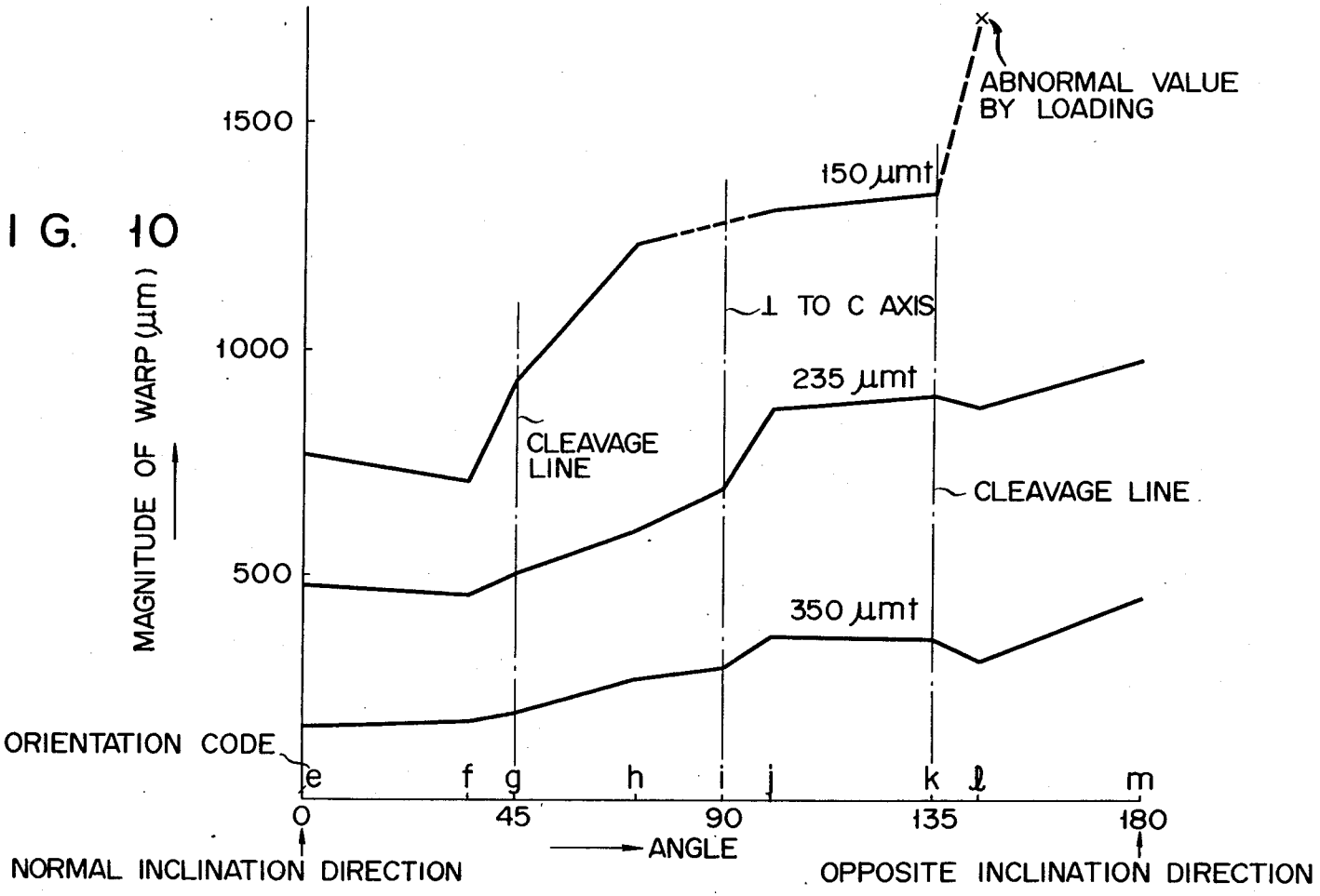

For further confirmation of the effect of this invention, the inventors carried out the following experiments. As shown in FIG. 8, sample sapphire wafers were respectively ground in nine directions indicated by the alphabetical letters ranging from e to m. Comparison was made between the magnitudes of the warp of the ground sample sapphire wafers. In FIG. 8, reference character P denotes the projection of the C axis. An arrow A shows the rigidly defined normal inclination direction of the C planes (0001) like the arrow A of FIG. 3. FIG. 9 is a sectional view on line X—X' of FIG. 8. The edges 3 of each C plane extend as shown in FIG. 9. The above-mentioned experiments used nine sample sapphire wafers each having a width of 150 microns, nine sample sapphire wafers each having a width of 235 microns, and nine sample sapphire wafers each having a width of 350 microns, the results being set forth in FIG. 10. FIG. 10 shows that, where grinding was carried out in the normal inclination direction of the C planes (0001) (in the directions of e and f), then the ground sapphire wafers suffered a smaller warp than when grinding was performed in the opposite inclination direction of the C planes (0001). Accordingly, wafers having small warp are obtained by grinding them in the normal inclination direction of the C planes (0001).

Figure 11:
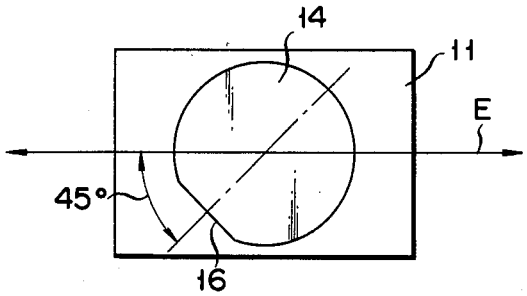

Description is now given with reference to FIGS. 11 and 12 of the method of grinding a sapphire wafer according to one embodiment of this invention. Reference numeral 11 denotes a sapphire wafer holder which is set on a work table 12 and linearly reciprocated in a grinding direction indicated by an arrow E. A sapphire wafer 14 is clamped to the surface of the wafer holder 11 in such a manner that the particles of a rotating grindstone 15 are moved in the rigidly defined normal inclination direction to the C planes (0001) of the sapphire wafer 14. The sapphire wafer 14 thus set causes an orientation flat 16 to define an angle of 45° to the grinding direction E (FIG. 11), because the orientation flat 16 is cut so as to define an angle of 45° to the projection P of the C axis [0001] of the sapphire wafer 14. The sapphire wafer 14 is fixed to the holder 11 in the above-mentioned manner. The holder 11 is linearly reciprocated in the grinding direction E. Under this condition, the grindstone 15 is rotated at high speed in the direction of an arrow F in contact with the surface or R plane $\{1\bar{1}02\}$ of the sapphire wafer 14 to smoothly grind said surface. Since, in the above-mentioned grinding process, the particles of the rotating grindstone 15 are moved in the normal inclination direction of the C planes (0001), the surface or R plane $\{1\bar{1}02\}$ is smoothly ground with very few grinding scars, thereby minimizing the warp of the ground sapphire wafer 14. The grindstone 15 is rotated at a far higher speed than that at which the wafer holder 11 makes a linear reciprocation. Therefore, the particles of the rotating grindstone 15 are always moved in the normal inclination direction of the C planes (0001) of the sapphire wafer 14, no matter whether the wafer 14 is moved in the grinding direction E away from the grindstone 15 or towards the grindstone 15. Consequently, the so-called "up cut" or "down cut" has no relationship with the sapphire wafer-grinding method of this invention. The sapphire wafer 14 may be fitted to the holder 11 by vacuum attachment via a small hole formed in the holder 11.

Description is now given with reference to FIG. 13 of a sapphire wafer-grinding method according to another embodiment of this invention by which a plurality of sapphire wafers 14 can be ground at the same time. In this case, too, all the sapphire wafers 14 are held on a work table 17 in such a manner that the particles of the rotating grindstone 15 are moved in the normal direction of the C planes (0001). As a result, the orientation flat 16 of each sapphire wafer 14 defines an angle of 45° to the grinding direction. In this case, too, the sapphire wafer 14 can be ground in the same manner as in the preceding embodiment, namely, in the normal inclination direction of the C planes (0001) of the sapphire wafer 14, for which the method of this invention is intended, thereby minimizing the warp of each ground sapphire wafer 14.

What is indispensable for the sapphire wafer-grinding method of this invention is the orienting of a sapphire wafer so that its plurality of C planes (0001) extend in parallel across the sapphire wafer at an inclination angle of about 57.6° to the surface or R plane $\{1\bar{1}02\}$ of said sapphire wafer, after which the particles of a rotating grindstone are moved in the normal inclination direction of the C planes (0001) to grind the surface or R plane $\{1\bar{1}02\}$. Any grinding process is applicable, provided the process can satisfy the above-mentioned requisite conditions. Therefore, this invention is obviously not limited to the aforesaid embodiments. Namely, the following embodiment is also applicable.

Referring to FIG. 14, a sapphire wafer 23 is fixed by means of a carrier (not shown) between a flat grindstone 21 and a round conical grindstone 22. As seen from FIG. 14, the top plane of the sapphire wafer 23 contacts the generating line of the round conical grindstone 22, and the bottom plane of the sapphire wafer 23 contacts the flat grindstone 21. Under the above-mentioned condition, the round conical grindstone 22 is rotated about a straight line G extending from the apical point and the center of the base plane. The flat grindstone 21 is rotated in a direction opposite to that in which said conical grindstone 22 is rotated about a straight line H which extends through the center of said flat grindstone 21 in perpendicular relationship to the horizontal plane thereof. Thus, the top plane is smoothly ground by the generating line of the round conical stone, and the bottom plane of said sapphire wafer 23 is also smoothly ground by the flat grindstone 21. Where the round conical grindstone 22 has a sufficiently long generating line and the sapphire wafer 23 is fixed at a point remote from the apical point of the round conical grindstone 22, the generating line of the round conical grindstone 22 may be considered to move in parallel with the surface of the sapphire wafer 23. Even where a sapphire wafer is ground by the above-mentioned process, the method of this invention is applicable. In this case, it is advised to fix the sapphire wafer 23 in such a manner that the generating line of the round conical grindstone 22 is moved in the normal inclination direction of the C planes (0001) of the sapphire wafer 23. This process causes the bottom plane of the sapphire wafer 23 to be also ground in the normal inclination direction of the C planes (0001) of the wafer 23 for which this invention is intended. The reason for this is that, relative to the surface or R plane $\{1\bar{1}02\}$ of the sapphire wafer 23, the nomral inclination direction of the C planes (0001) of the bottom plane of the sapphire wafer 23 runs opposite to that of the top plane thereof, and the flat grindstone 21 is rotated in the opposite direction to the round conical grindstone 22. If, therefore, the top plane of the sapphire wafer 23 is ground in the normal inclination direction of the C planes (0001), then the bottom plane of said sapphire wafer 23 can also be ground in the normal inclination direction of the C planes (0001). Thus, the method according to the third embodiment of the invention enables both planes of a sapphire wafer to be simultaneously ground in the normal inclination direction of the C planes (0001), for which the invention is intended.

What we claim is:

1. A method of grinding a sapphire wafer the main surface of which is the R plane $\{1\bar{1}02\}$ and which has a plurality of parallel C planes (0001) intersecting said R plane $\{1\bar{1}02\}$ at an angle of 57.6° C., said method comprising the steps of:

(a) holding said sapphire wafer in position to grind the main surface of said sapphire wafer and (b) grinding the main surface of said sapphire wafer with a grindstone such that the working surface of said grindstone moves in a direction which:

(i) is perpendicular to the parallel lines defined by the intersection of said C planes (0001) with said R plane $\{1\bar{1}02\}$ with an accuracy of I 35° lateral deflection in said R plane $\{1\bar{1}02\}$ and (ii) is from the acute angle side to the obtuse angle side of the angles formed at the intersections between said C planes (0001) and said R plane $\{1\bar{1}02\}$.

2. A method as recited in claim 1 wherein the working surface of said grindstone moves perpendicularly to said parallel lines.

* * * * *